US006267373B1

(12) United States Patent
Takata

(10) Patent No.: US 6,267,373 B1
(45) Date of Patent: Jul. 31, 2001

(54) BEARING STRUCTURE FOR ROTATABLE SHAFT

(75) Inventor: Kenji Takata, Minamiashigara (JP)

(73) Assignee: Fuji Photo Film Co., Ltd., Kanagawa-Ken (JP)

( * ) Notice: Subject to any disclaimer, the term of this patent is extended or adjusted under 35 U.S.C. 154(b) by 0 days.

(21) Appl. No.: 09/274,482

(22) Filed: Mar. 23, 1999

(30) Foreign Application Priority Data

Mar. 27, 1998 (JP) ..... 10-082023

(51) Int. Cl.[7] ..... B65H 5/00; B65H 5/02

(52) U.S. Cl. ..... 271/274; 198/835; 193/37; 403/71; 403/92; 403/95; 403/97; 403/111; 403/349

(58) Field of Search ..... 271/274; 198/835; 193/37, 35 B; 403/111, 348, 349, 396, 397, 68, 69, 71, 92, 93, 95, 97, 98, 118

(56) References Cited

U.S. PATENT DOCUMENTS 4,850,584 * 7/1989 Watashi ..... 271/274
5,044,624 * 9/1991 Haus et al. ..... 271/274
5,600,426 * 2/1997 Gramlich et al. ..... 399/381 X

FOREIGN PATENT DOCUMENTS 54-71159 5/1979 (JP) .

* cited by examiner

*Primary Examiner*—Christopher P. Ellis
*Assistant Examiner*—Kenneth W Bower
(74) *Attorney, Agent, or Firm*—Sughrue, Mion, Zinn Macpeak & Seas, PLLC

(57) ABSTRACT

A bearing structure has first and second support members in which first and second stepped small-diameter portions of drive and nip rollers are rotatably mounted by bearings. The first and second support members are disposed in respective first and second holes defined in a side wall and have respective first and second inner engaging teeth and respective first and second outer engaging flanges which are held against respective opposite surfaces of the side wall to retain the first and second support members on the side wall against removal. The first and second support members thus firmly retained in position on the side wall can reliably bear thrust forces from the drive roller and the nip roller. The drive roller and the nip roller and the bearings can be assembled and serviced with ease. First and second snap-fitting gears mounted on the first and second stepped small-diameter portions adjacent to the first and second support members, respectively, are effectively protected against damage because thrust forces from the drive roller and the nip roller are borne by the first and second support members.

18 Claims, 9 Drawing Sheets

BEARING STRUCTURE FOR ROTATABLE SHAFT

BACKGROUND OF THE INVENTION

1. Field of the Invention

The present invention relates to a bearing structure for a rotatable shaft having an end rotatably supported by a side wall.

2. Description of the Related Art

It is known to provide a radiation image recording and reproducing system for recording radiation image information of a subject, such as a human body, using a stimulable phosphor, and either reproducing the recorded radiation image information on a photosensitive medium such as a photographic film or the like or displaying the recorded radiation image information on a cathoderay tube or other display units.

When a radiation energy such as X-rays, α-rays, γ-rays, electron beams, ultraviolet radiation, or the like is applied to a certain phosphor, it stores part of the applied radiation energy. When stimulating light such as visible light is subsequently applied to the phosphor, the phosphor emits light depending the stored radiation energy. Such a phosphor is referred to as a stimulable phosphor. A stimulable phosphor is usually used in the form of a sheet which is referred to as a stimulable phosphor sheet.

The radiation image recording and reproducing system includes an image information reading apparatus comprising a reading unit for reading image information recorded on a stimulable phosphor sheet and an erasing unit for erasing remaining image information from the stimulable phosphor sheet after the recorded image information has been read therefrom by the reading unit. The image information reading apparatus has a cassette loading section for receiving therein a cassette which stores a stimulable phosphor sheet on which radiation image information of a subject has been recorded by an external exposure unit.

After the cassette is inserted into the cassette loading section, the lid of the cassette is opened, and the stimulable phosphor sheet is removed from the cassette by a sheet feeding mechanism. The removed stimulable phosphor sheet is then delivered to the reading unit by a sheet delivering mechanism. The reading unit reads the radiation image information from the stimulable phosphor sheet by applying stimulating light to the stimulable phosphor sheet. Thereafter, the stimulable phosphor sheet is delivered to the erasing unit, which erases remaining image information from the stimulable phosphor sheet. The stimulable phosphor sheet is then delivered back and inserted into the cassette in the cassette loading section.

The radiation image recording and reproducing system also includes an image information reproducing apparatus comprising a recording unit for recording radiation image information on a photosensitive medium. The image information reproducing apparatus carries a magazine which stores a plurality of photosensitive mediums. One, at a time, of the photosensitive mediums is removed from the magazine, and delivered to the recording unit by a sheet delivering mechanism. The recording unit records the radiation image information read from a stimulable phosphor sheet on the photosensitive medium by scanning the photosensitive medium with a laser beam that has been modulated by the radiation image information.

Both the image information reading apparatus and the image information reproducing apparatus have a number of roller pairs each comprising a pair of rollers held in rolling contact with each other, for delivering a stimulable phosphor sheet or a photosensitive medium (hereinafter also referred to as a "sheet"). Specifically, one of the rollers of each roller pair comprises a drive roller which is driven to rotate about its own axis and the other roller comprises a nip roller which can move into and out of rolling contact with the drive roller. The drive roller and the nip roller grip a sheet therebetween and deliver the sheet upon rotation of the drive roller.

Roller pairs are employed in the sheet delivering mechanisms for delivering sheets to the reading unit and the recording unit, and also in auxiliary scanning mechanisms for feeding sheets in an auxiliary scanning direction in the reading unit and the recording unit. Usually, such a roller pair extends between and is rotatably mounted on side walls. To install each of the rollers of the roller pair, plain bearings or ball bearings are attached to respective opposite ends of the shaft of the roller, and then E-rings are attached to the ends of the shaft to retain the plain bearings or the ball bearings in position against unwanted movement on the shaft in the axial direction.

However, since E-rings cannot easily be attached and removed, using them is detrimental to the efficiency with which to assemble and service the rollers and the bearings. Particularly in cases where many roller pairs are employed, the processes of assembling and servicing the rollers and the bearings are considerably tedious and time-consuming.

E-rings may be dispensed with if snap-fitting gears, directly mounted on the shaft, are used to prevent the plain bearings or the ball bearings from axially moving on the shaft. The snap-fitting gears have fingers therein which snap in corresponding recesses defined in the shaft when the snap-fitting gears are installed on the shaft. While the shaft is rotating, thrust-induced stresses are applied to the fingers, which are subjected to relatively large thrust forces acting on the shaft. Consequently, the fingers tend to become damaged quickly, and the snap-fitting gears are poor in durability.

SUMMARY OF THE INVENTION

It is therefore a major object of the present invention to provide a bearing structure for a rotatable shaft, which is capable of effectively bearing stresses caused by thrust forces acting on the rotatable shaft, allows bearings and other parts to be easily assembled and serviced, and can reliably protect parts on the shaft against damage.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
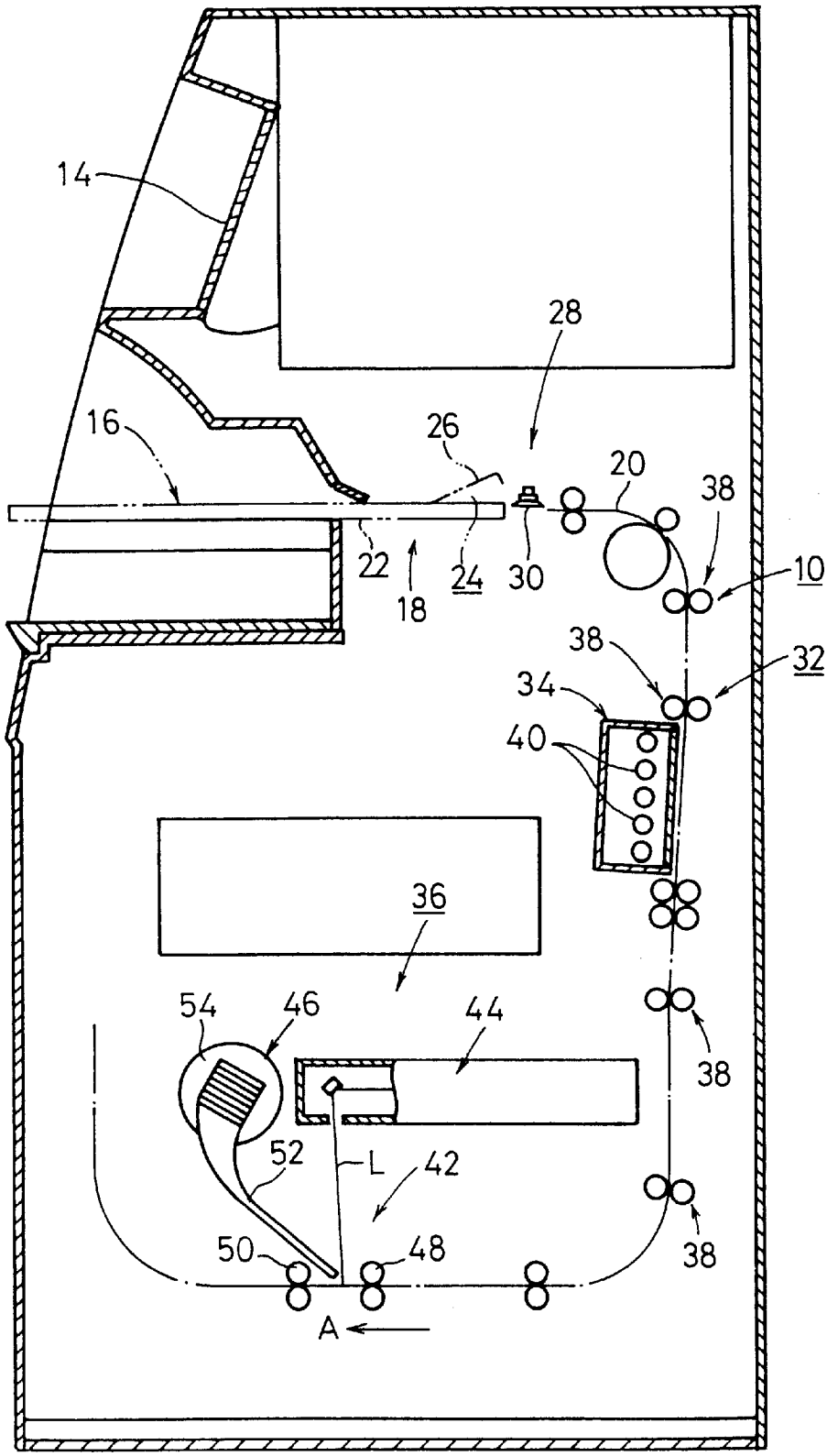
FIG. 1 is a schematic vertical cross-sectional view of an image information reading apparatus which incorporates bearing structures according to a first embodiment of the present invention.
Figure 2:
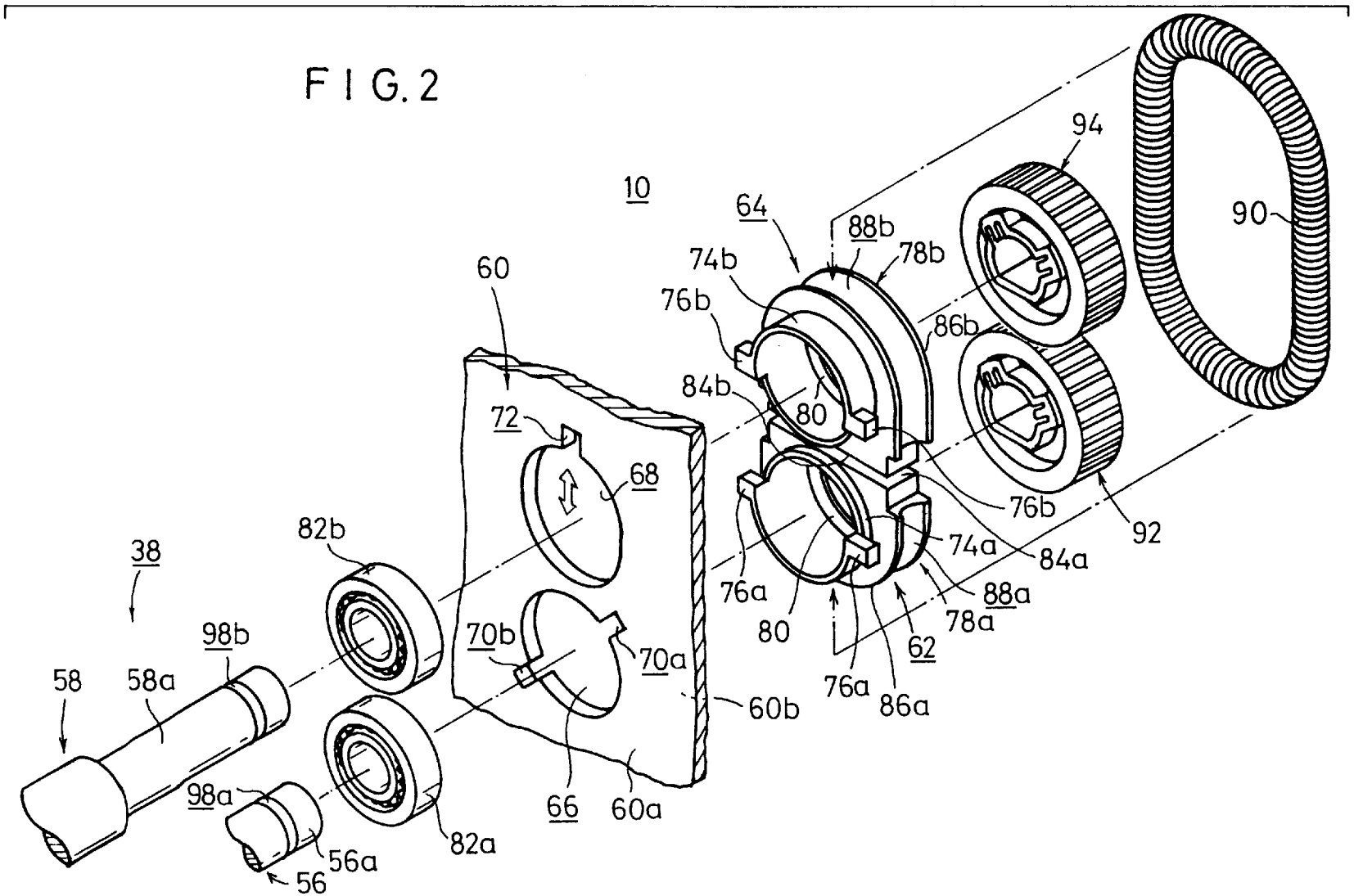
FIG. 2 is an exploded perspective view of a roller pair which is combined with the bearing structure according to the first embodiment of the present invention.
Figure 3:
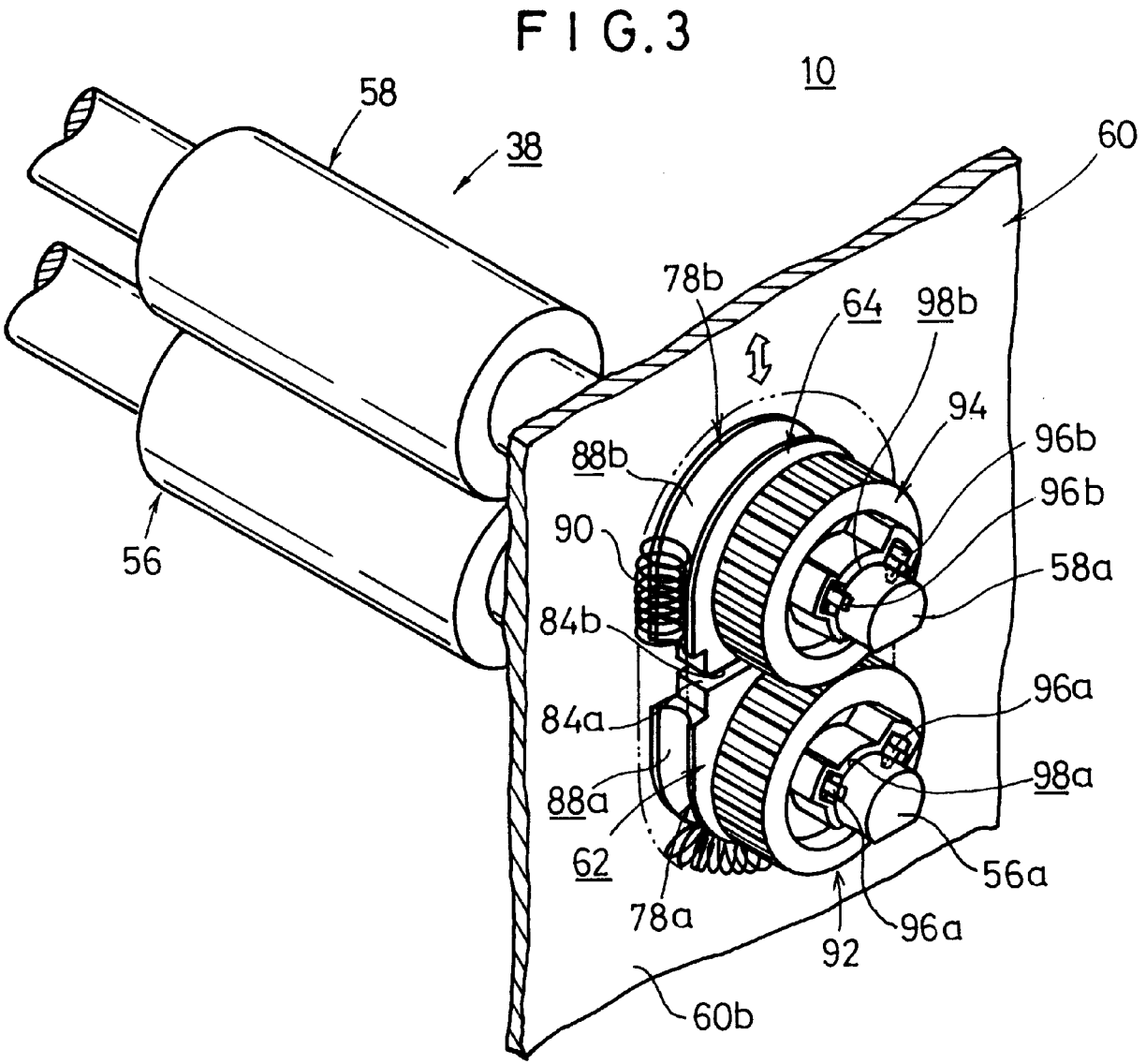
FIG. 3 is a perspective view of the bearing structure shown in FIG. 2.
Figure 4:
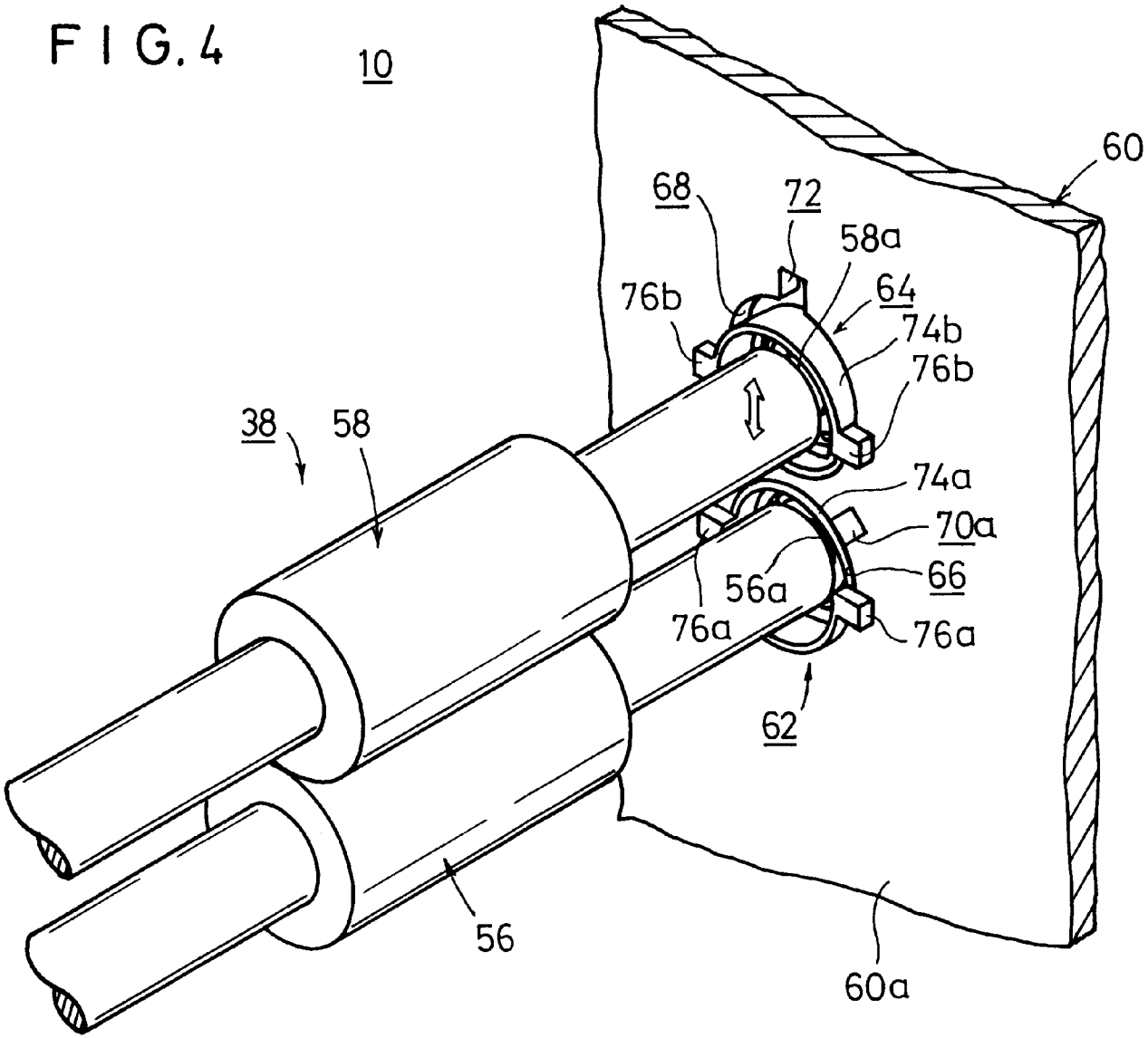
FIG. 4 is a perspective view of the bearing structure shown in FIG. 2, as viewed from the roller pair.
Figure 5:
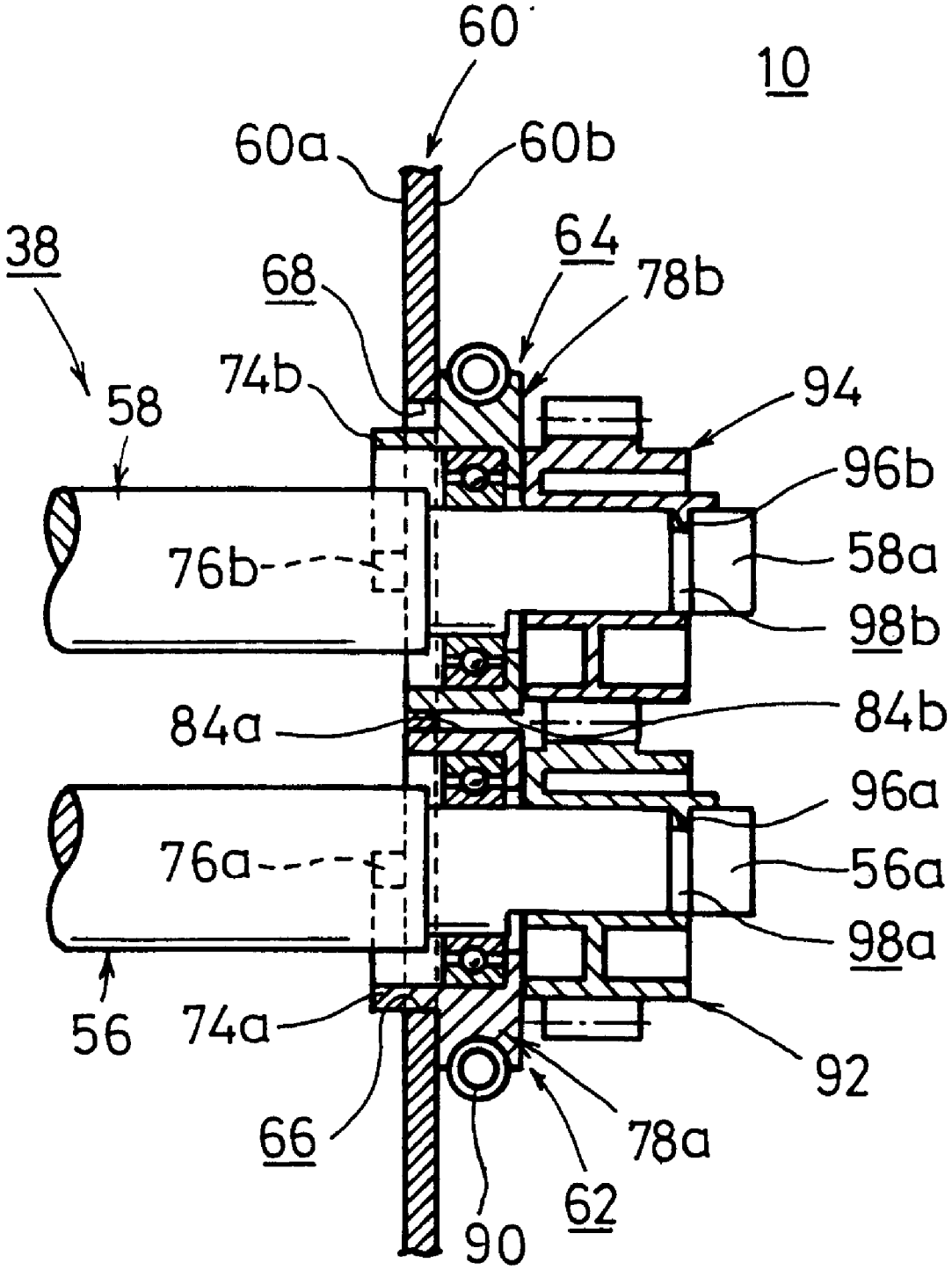
FIG. 5 is a cross-sectional view of the bearing structure shown in FIG. 2.

FIG. 1 shows in schematic vertical cross section an image information reading apparatus 12 which incorporates bearing structures 10 according to a first embodiment of the present invention.

As shown in FIG. 1, the image information reading apparatus 12 has a touch panel 14 on an upper front face thereof which serves as a control console and a monitor. The image information reading apparatus 12 also has a cassette loading section 18 disposed below the touch panel 14 for loading a cassette 16 removably in a sheet removal position. The cassette 16 comprises a housing 22 for storing a stimulable phosphor sheet 20 therein, and a lid 26 mounted on the housing 22 for opening and closing an opening 24 defined in the housing 22. The cassette loading section 18 has a lid opening/closing mechanism (not shown) for opening and closing the lid 26.

The cassette loading section 18 includes a sheet feeder 28 for removing the stimulable phosphor sheet 20 from the cassette 16 and returning the stimulable phosphor sheet 20 to the cassette 16 after remaining radiation image information has been erased therefrom. The sheet feeder 28 has a plurality of suction cups 30 communicating with a vacuum source (not shown).

The image information reading apparatus 12 also has an erasing unit 34 and a reading unit 36 which are disposed below and connected to the sheet feeder 28 through a sheet delivery system 32. The sheet delivery system 32 has a plurality of roller pairs 38 spaced along a vertical delivery path. The erasing unit 34 has a plurality of erasing light sources 40 disposed in a position on one side of the vertical delivery path.

The reading unit 36 comprises an auxiliary scanning feeding mechanism 42 for delivering the stimulable phosphor sheet 20 from the cassette 16 in an auxiliary scanning direction indicated by the arrow A, an optical system 44 for applying a laser beam L as it is deflected in a main scanning direction (substantially perpendicular to the auxiliary scanning direction) to the stimulable phosphor sheet 20 as it is delivered in the auxiliary scanning direction, and a light guiding system 46 for photoelectrically reading light which is emitted from the stimulable phosphor sheet 20 when the stimulable phosphor sheet 20 is exposed to the laser beam L.

The auxiliary scanning feeding mechanism 42 has first and second roller pairs 48, 50 rotatable in synchronism with each other. The light guiding system 46 has a light guide 52 disposed near the position where the stimulable phosphor sheet 20 is scanned by the laser beam L and extending in the main scanning direction, and a photomultiplier 54 mounted on an upper end of the light guide 52.

The bearing structures 10 according to the first embodiment of the present invention are combined respectively with the roller pairs 38 of the sheet delivery system 32 and the roller pairs 48, 50 of the auxiliary scanning feeding mechanism 42.

As shown in FIGS. 2 through 5, each of the roller pairs 38 comprises a drive roller (first roller) 56 and a nip roller (second roller) 58 which can move into and out of rolling contact with the drive roller 56. The drive roller 56 and the nip roller 58 have first and second stepped small-diameter portions 56a, 58a, respectively, on their opposite ends.

Each of the bearing structures 10 has first and second support members 62, 64 mounted on a side wall 60, and the first and second stepped small-diameter portions 56*a*, 58*a* are rotatably inserted and supported in the respective first and second support members 62, 64. The side wall 60 has first and second holes 66, 68 defined therein which receive the first and second support members 62, 64 respectively therein. The first hole 66 is circular in shape, and communicates with first recesses 70*a*, 70*b* which are defined in the side wall 60 in diametrically opposite relation to each other across the first hole 66 along an oblique line. The second hole 68 is vertically elliptical in shape and has its major axis directed toward the first hole 66. The second hole 68 communicates with a second recess 72 which is defined in the side wall 60 at an upper end of the second hole 68.

The first and second support members 62, 64 have respective first and second tubular sleeves 74*a*, 74*b* disposed respectively in the first and second holes 66, 68 in the side wall 60. Respective pairs of first and second inner engaging teeth 76*a*, 76*b* project radially outwardly from ends of the first and second tubular sleeves 74*a*, 74*b* and engage with a wall surface 60*a* of the side wall 60. Respective first and second outer engaging flanges 78*a*, 78*b* project radially outwardly from opposite ends of the first and second tubular sleeves 74*a*, 74*b* and engage with an opposite wall surface 60*b* of the side wall 60.

The first inner engaging teeth 76*a* comprise a pair of diametrically opposite bars projecting radially outwardly from the end of the first tubular sleeve 74*a*. The first support member 62 has an inner stepped flange 80 on the opposite end of the first tubular sleeve 74*a*. A first bearing 82*a* is disposed in the first tubular sleeve 74*a* and held against the inner stepped flange 80. The first outer engaging flange 78*a* is of an arcuate shape having a first flat surface 84*a* which serves to prevent the first support member 62 from being angularly moved about its own axis and an arcuate surface 86*a* extending from the first flat surface 84*a* around the axis of the first support member 62. The arcuate surface 86*a* has a guide groove 88*a* defined therein which has a U-shaped cross-sectional shape.

The second support member 64 is identical in structure to the first support member 62. Specifically, the second inner engaging teeth 76*b* and the second outer engaging flange 78*b* are integrally disposed on the respective opposite ends of the second tubular sleeve 74*b*. The second support member 64 has an inner stepped flange 80 on the opposite end of the second tubular sleeve 74*b*. A second bearing 82*b* is disposed in the second tubular sleeve 74*b* and held against the inner stepped flange 80. The second outer engaging flange 78*b* is of an arcuate shape having a second flat surface 84*b* which serves to prevent the second support member 64 from being angularly moved about its own axis and an arcuate surface 86*b* extending from the second flat surface 84*b* around the axis of the second support member 64. The arcuate surface 86*b* has a guide groove 88*b* defined therein which has a U-shaped cross-sectional shape.

The first and second support members 62, 64 are disposed respectively in the first and second holes 66, 68, with the first and second flat surfaces 84*a*, 84*b* facing each other in a closely spaced relation to each other. An endless helical spring 90 extends around the arcuate surfaces 86*a*, 86*b* and is disposed in the guide grooves 88*a*, 88*b*. The drive roller 56 and the nip roller 58 are held in rolling contact with each other under desired nipping forces due to the tension of the endless helical spring 90. The nip roller 58 is movable vertically toward and away from the drive roller 56 because the second tubular sleeve 74*b* is movable in the second hole 68.

First and second snap-fitting gears 92, 94 are removably mounted respectively on the first and second stepped small-diameter portions 56*a*, 58*a* adjacent to the first and second support members 62, 64, respectively. The first and second snap-fitting gears 92, 94 have respective pairs of fingers 96*a*, 96*b* which are snappingly engageable in respective annular grooves 98*a*, 98*b* defined in the first and second stepped small-diameter portions 56*a*, 58*a*.

The bearing structures 10 which are combined respectively with the roller pairs 48, 50 of the auxiliary scanning feeding mechanism 42 are identical in structure to the bearing structure 10 described above, and will not be described in detail below.

Operation of the bearing structures 10 according to the first embodiment of the present invention will be described below in relation to the image information reading apparatus 12 which incorporates the bearing structures 10.

A stimulable phosphor sheet 20 which carries radiation image information of a subject such as a human body recorded by an exposure device (not shown) is stored in the cassette 16 in a light-tight fashion, and the cassette 16 is then set in the cassette loading section 18 of the image information reading apparatus 12. After being loaded in the cassette loading section 18, the lid 26 of the cassette 16 is swung to a given angular position by the lid opening/closing mechanism in the cassette loading section 18, opening the opening 24 of the cassette 16.

Then, the sheet feeder 28 is actuated to move the suction cups 30 into the cassette 16, and the suction cups 30 are evacuated to attract the stimulable phosphor sheet 20 stored in the cassette 16. The suction cups 30 which have attracted the stimulable phosphor sheet 20 are moved out of the cassette 16 toward the sheet delivery system 32 until a leading end of the stimulable phosphor sheet 20 is gripped by a first one of the roller pairs 38 of the sheet delivery system 32.

When the leading end of the stimulable phosphor sheet 20 is gripped by the first roller pair 38, the suction cups 30 release the stimulable phosphor sheet 20. The stimulable phosphor sheet 20 is now transferred to the sheet delivery system 32, which delivers the stimulable phosphor sheet 20 through the erasing unit 34 to the reading unit 36.

In the reading unit 36, since the roller pairs 48, 50 are rotating in synchronism with each other, the stimulable phosphor sheet 20 is delivered in the auxiliary scanning direction indicated by the arrow A by the roller pairs 48, 50, and the optical system 44 is energized to apply the laser beam L to the stimulable phosphor sheet 20 in the main scanning direction. Upon exposure to the laser beam L, the stimulable phosphor sheet 20 emits light depending on the radiation image information recorded on the stimulable phosphor sheet 20. The emitted light is led from the light guide 52 to the photomultiplier 54, which photoelectrically reads the radiation image information that is carried by the light emitted from the stimulable phosphor sheet 20.

After the recorded radiation image information has thus been read from the stimulable phosphor sheet 20 by the reading unit 36, the stimulable phosphor sheet 20 is delivered back by the sheet delivery system 32. When the stimulable phosphor sheet 20 moves upwardly along the vertical delivery path, the stimulable phosphor sheet 20 passes through the erasing unit 34. While the stimulable phosphor sheet 20 is passing through the erasing unit 34, the erasing light sources 40 apply light to the stimulable phosphor sheet 20 thereby to erase unwanted remaining radiation image information from the stimulable phosphor sheet 20. The stimulable phosphor sheet 20 is continuously delivered into the sheet feeder 28, which then returns the stimulable phosphor sheet 20 into the cassette 16. Thereafter, the cassette 16 is withdrawn from the cassette loading section 18. At this time, the lid 26 is turned back to the housing 22 by the lid opening/closing mechanism in the cassette loading section 18. The cassette 16 with its opening 24 closed by the lid 26 in a light-tight manner is now taken out of the image information reading apparatus 12.

As described above, each of the roller pairs of the sheet feed system 32 and the first and second roller pairs 48, 50 of the auxiliary scanning feeding mechanism 42 is combined with the bearing structure 10 according to the first embodiment of the present invention, as shown in FIGS. 2 through 5. A process of assembling each of the roller pairs 38, for example, together with the bearing structure 10 will be described below.

First, the first and second support members 62, 64 are attached to the side plate 60. Specifically, the first inner engaging teeth 76*a* of the first support member 62 are angularly oriented in alignment with the respective first recesses 70*a*, 70*b* defined in the side wall 60, and then the first support member 62 is inserted into the first hole 66. At this time, the first inner engaging teeth 76*a* pass through the respective first recesses 70*a*, 70*b*. Then, the first support member 62 is turned about its own axis until the first flat surface 84*a* is positioned upwardly of the arcuate surface 86*a* and lies horizontally, whereupon the first tubular sleeve 74*a* of the first support member 62 is placed in the first hole 66, the first inner engaging teeth 76*a* are held against the wall surface 60*a* of the side wall 60, and the first outer engaging flange 78*a* is held against the opposite wall surface 60*b* of the side wall 60. The first support member 62 is now retained on the side wall 60 against removal.

The second inner engaging teeth 76*b* of the second support member 64 are aligned respectively with the second recess 72 defined in the side wall 60 and the lower end of the elliptical second hole 68, and then the second support member 64 is inserted into the second hole 68. At this time, the second inner engaging teeth 76*b* pass through the second recess 72 and the second hole 68. Then, the second support member 64 is turned approximately 90° about its own axis until the second flat surface 84*b* is positioned downwardly of the arcuate surface 86*b* and lies horizontally. The side wall 60 is now gripped between the second inner engaging teeth 76*b* and the second outer engaging flange 78*b*. The second support member 64 is now retained on the side wall 60 against removal. The first and second flat surfaces 84*a*, 84*b* are disposed in vertically facing relation to each other. These facing first and second flat surfaces 84*a*, 84*b* are effective in preventing the first and second support members 62, 64 from being unduly angularly moved about their own axes because the first and second flat surfaces 84*a*, 84*b* engage each other when the first and second support members 62, 64 are turned.

The first and second bearings 82*a*, 82*b* have already been disposed in the first and second support members 62, 64, respectively. The first and second stepped small-diameter portions 56*a*, 58*a* of the drive roller 56 and the nip roller 58 are inserted into the first and second bearings 82*a*, 82*b*, respectively. The first and second gears 92, 94 are installed respectively on the first and second stepped small-diameter portions 56*a*, 58*a*, with the fingers 96*a*, 96*b* snapped into the annular grooves 98*a*, 98*b* defined in the first and second stepped small-diameter portions 56*a*, 58*a*.

The endless helical spring 90 is placed around the arcuate surfaces 86*a*, 86*b* and received in the guide grooves 88*a*, 88*b*. Therefore, the nip roller 58 is pressed toward the drive roller 56 under the resiliency of the endless helical spring 90. When the stimulable phosphor sheet 20 starts to be gripped by the roller pair 38, the nip roller 58 is displaced, together with the second support member 64 inserted in the elliptical second hole 68, away from the drive roller 56, allowing the stimulable phosphor sheet 20 to pass between the drive roller 56 and the nip roller 58.

In the first embodiment, the first and second support members 62, 64 are retained in position on the side wall 60 by the first and second inner engaging teeth 76*a*, 76*b* and the first and second outer engaging flanges 78*a*, 78*b*, and hence can reliably bear thrust forces from the drive roller 56 and the nip roller 58. Accordingly, no E-rings are necessary to hold the bearings 82*a* , 82*b* in position, and hence the roller pair 38 and the bearings 82*a*, 82*b* can be assembled and serviced with ease.

Though the sheet delivery system 32 has a number of roller pairs 38, the overall process of assembling and maintaining those roller pairs 38 can be carried out easily in a short period of time. Furthermore, since thrust forces from the drive roller 56 and the nip roller 58 are borne by the first and second support members 62, 64, no thrust forces are applied to the fingers 96*a*, 96*b* of the first and second snap-fitting gears 92, 94 mounted respectively on the first and second stepped small-diameter portions 56*a*, 58*a*. As a result, the fingers 96*a*, 96*b* are protected against undue damage, and hence the first and second snap-fitting gears 92, 94 have a long service life.

Figure 6:
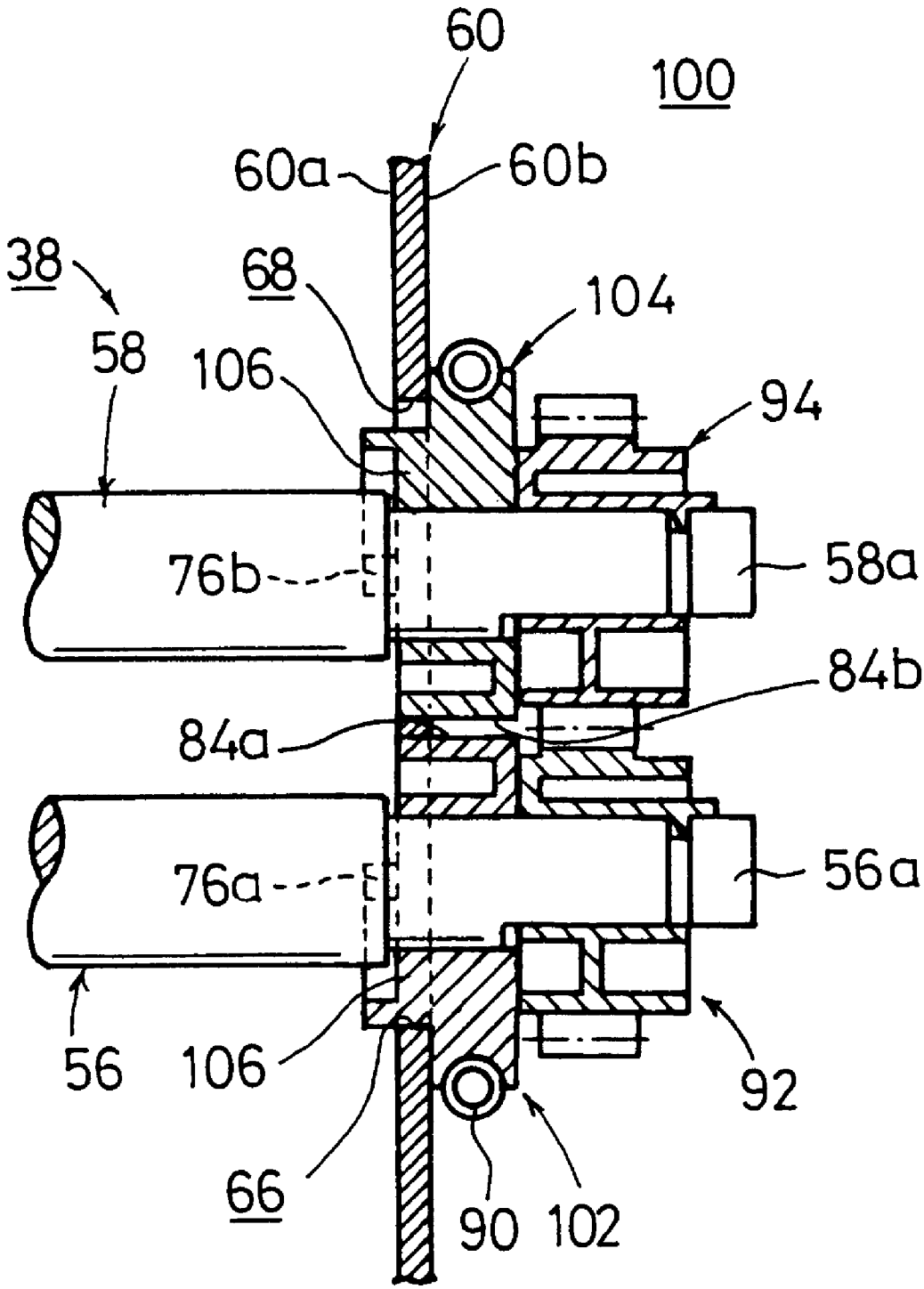
FIG. 6 is a cross-sectional view of a bearing structure according to a second embodiment of the present invention.

FIG. 6 shows in cross section a bearing structure 100 according to a second embodiment of the present invention. Those parts of the bearing structure 100 which are identical to those of the bearing structure 10 according to the first embodiment are denoted by identical reference characters, and will not be described in detail below.

As shown in FIG. 6, the bearing structure 100 according to the second embodiment has first and second support members 102, 104 including respective bearings 106 integrally formed therewith. The first and second stepped small-diameter portions 56*a*, 58*a* of the drive roller 56 and the nip roller 58 are inserted in the respective bearings 106. Since the bearing structure 100 has no separate bearings 82*a*, 82*b*, the bearing structure 100 is constructed of a reduced number of parts.

Figure 7:
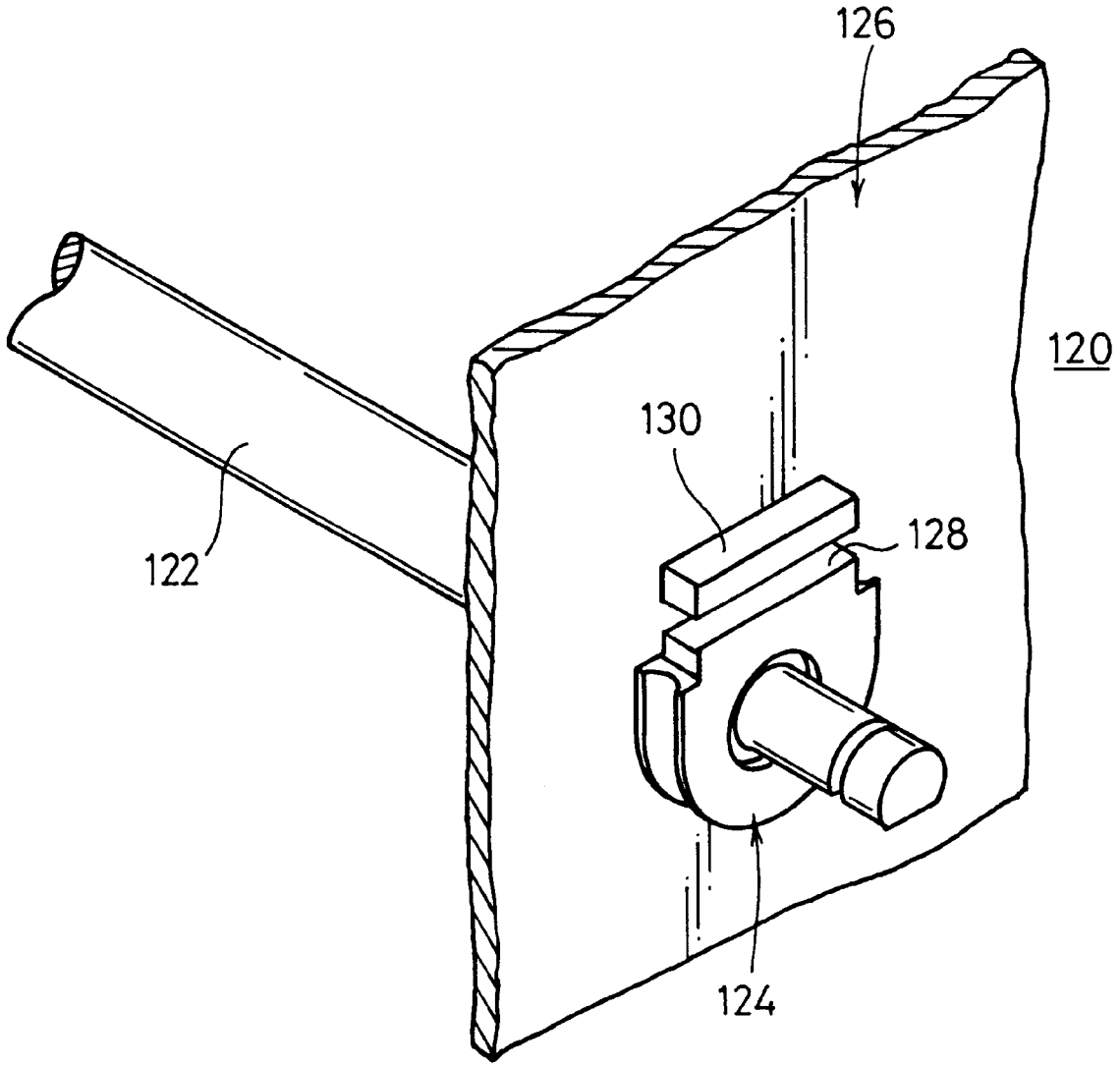
FIG. 7 is a perspective view of a bearing structure according to a third embodiment of the present invention.

FIG. 7 shows in perspective a bearing structure 120 according to a third embodiment of the present invention. As shown in FIG. 7, the bearing structure 120 has a support member 124 in which a drive shaft 122 is rotatably supported by a bearing. The support member 124 is removably mounted on a side wall 126, and is basically identical to the first support member 62 of the bearing structure 10 according to the first embodiment or the first support member 102 of the bearing structure 100 according to the second embodiment.

The support member 124, in which the single drive shaft 122 is rotatably supported by the bearing, has a flat surface 128 which faces a ledge 130 separately or integrally mounted on the side wall 126. The support member 124 is prevented from being unduly angularly moved about its own axis because the flat surface 128 is engaged by the ledge 130 when the support member 124 is turned. The bearing structure 120 according to the third embodiment also does not require any E-rings, and offers the same advantages as those of the bearing structures 10, 100 according to the first and second embodiments. In addition, the bearing structure 120 is capable of supporting the single drive shaft 122, rather than a pair of shafts or rollers.

Figure 8:
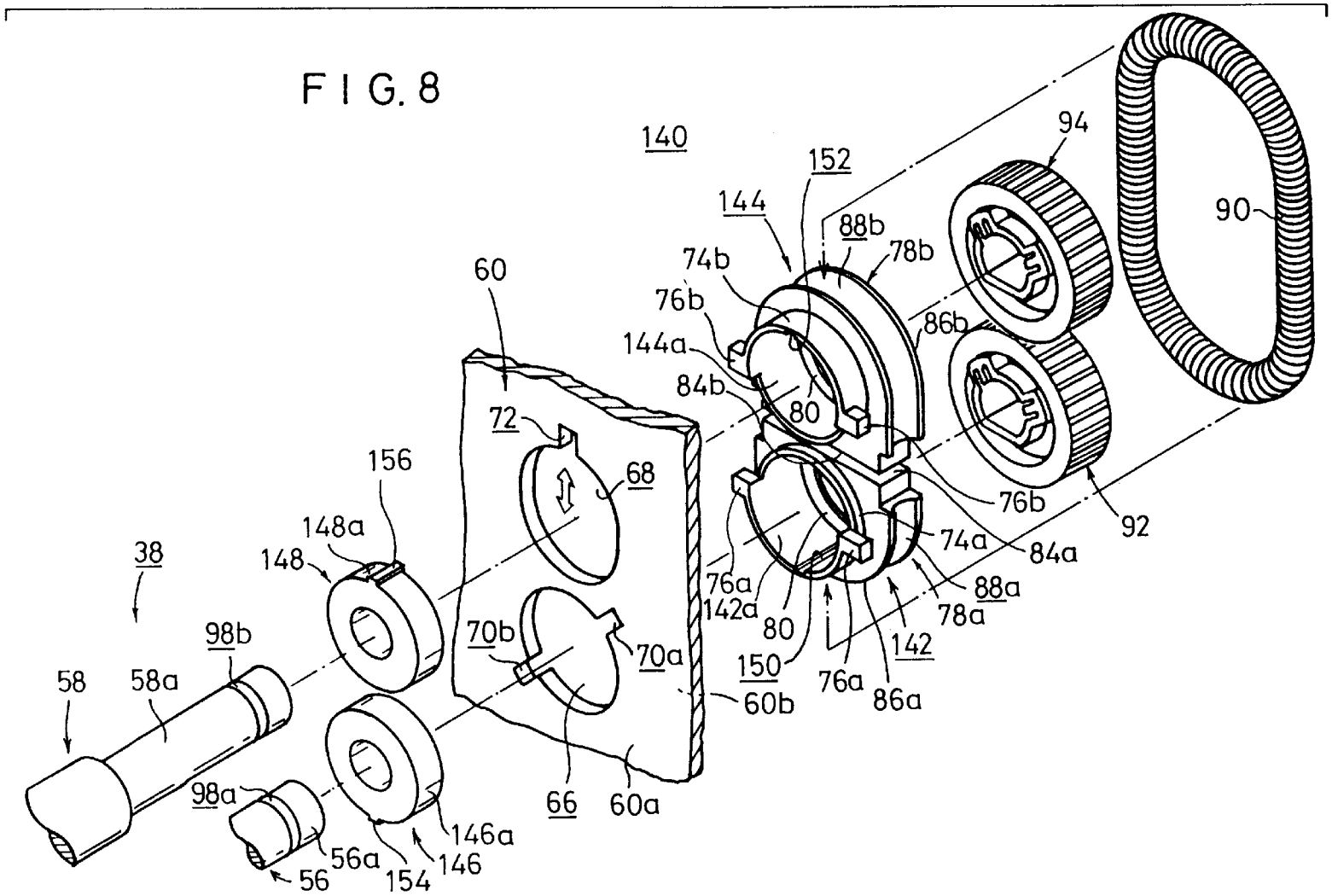
FIG. 8 is an exploded perspective view of a roller pair which is combined with a bearing structure according to a fourth embodiment of the present invention.
Figure 9:
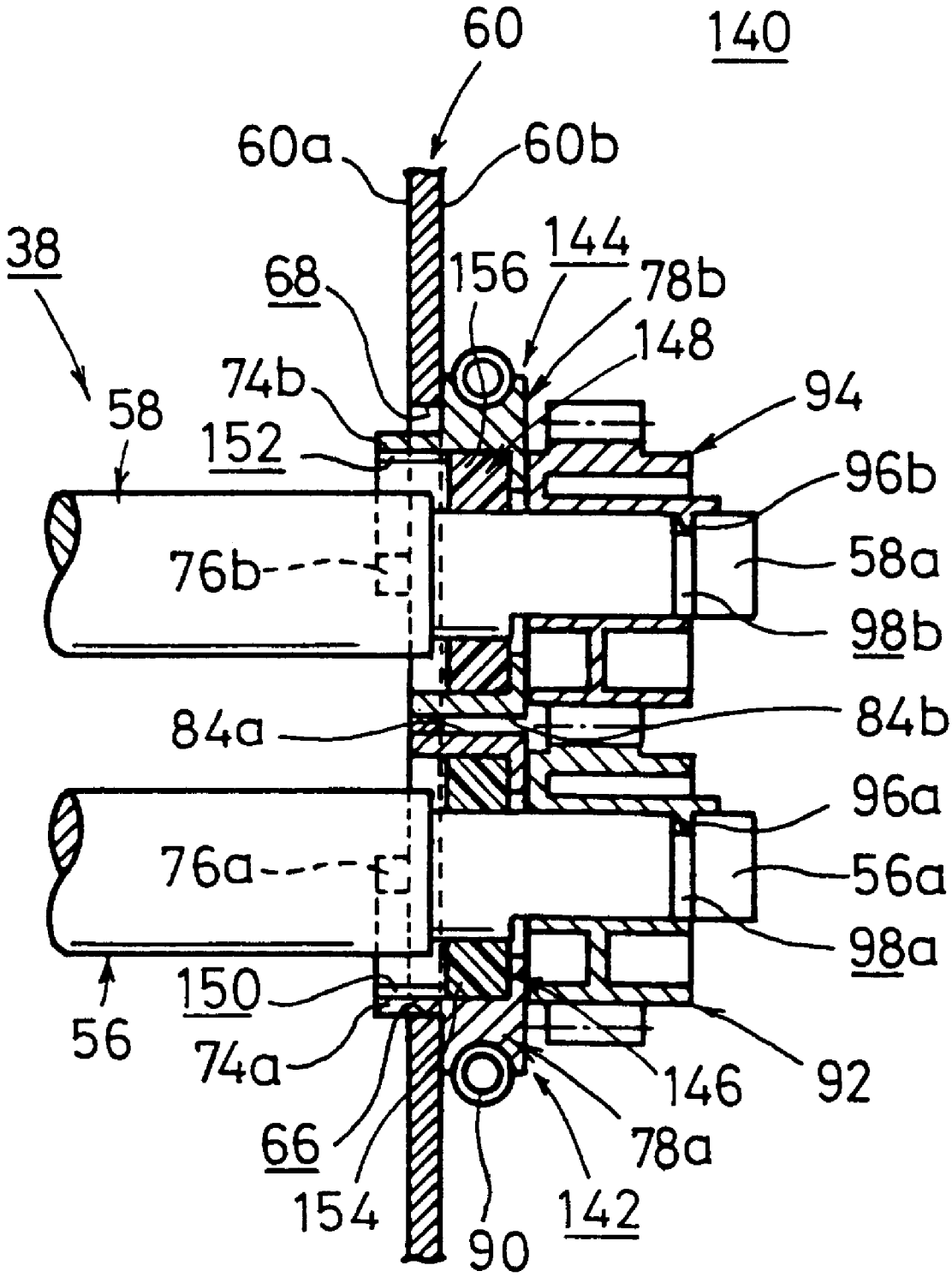
FIG. 9 is a cross-sectional view of the bearing structure shown in FIG. 8.

FIGS. 8 and 9 show a roller pair 38 which is combined with a bearing structure 140 according to a fourth embodiment of the present invention. Those parts of the bearing structure 140 which are identical to those of the bearing structure 10 according to the first embodiment are denoted by identical reference characters, and will not be described in detail below.

As shown in FIGS. 8 and 9, the bearing structure 140 according to the fourth embodiment has first and second support members 142, 144 mounted on a side wall 60, and first and second bearings 146, 148 of synthetic resin disposed respectively in the first and second support members 142, 144. The first and second support members 142, 144 are essentially identical in structure to the first and second support members 62, 64, respectively. The first and second stepped small-diameter portions 56*a*, 58*a* are rotatably inserted and supported in the respective first and second bearings 146, 148. The first and second support members 142, 144 have respective inner circumferential surfaces 142*a*, 144*a* in the respective first and second tubular sleeves 74*a*, 74*b*. The inner circumferential surfaces 142*a*, 144*a* have respective axial grooves (first engaging surfaces) 150, 152 defined therein. The first and second bearings 146, 148 have respective outer circumferential surfaces 146*a*, 148*a* which have respective axial ridges (second engaging surfaces) 154, 156 fitted respectively in the axial grooves 150, 152.

The first and second support members 142, 144 need to be made of a highly strong material because their first and second inner engaging teeth 76*a*, 76*b* engage the side wall 60 to retain the first and second support members 142, 144 on the side wall 60. The first and second bearings 146, 148 need to be made of a highly slippery and wear-resistant material because the first and second stepped small-diameter portions 56*a*, 58*a* are rotatably inserted and supported in the respective first and second bearings 146, 148.

According to the fourth embodiment, only the first and second bearings 146, 148 are made of polytetrafluoroethylene (PTFE), for example, which is relatively expensive, as a highly slippery and wear-resistant material. The bearing structure 140, with its first and second bearings 146, 148 made of such a highly slippery and wear-resistant material, can be kept in service with accurate dimensional and operational stability for a long period of time.

Furthermore, the grooves 150, 152 are defined in the inner circumferential surfaces 142*a*, 144*a* of the first and second support members 142, 144, and the ridges 154, 156 are disposed on the outer circumferential surfaces 146*a*, 148*a* of the first and second bearings 146, 148. With the ridges 154, 156 fitted respectively in the grooves 150, 152, the first and second support members 142, 144 and the first and second bearings 146, 148 are prevented from being turned relatively to each other and hence from undue abrasive damage which would otherwise be caused if frictional sliding motion occurred between the first and second support members 142, 144 and the first and second bearings 146, 148.

While the grooves 150, 152 are defined in the inner circumferential surfaces 142*a*, 144*a*, and the ridges 154, 156 are disposed on the outer circumferential surfaces 146*a*, 148*a* in the fourth embodiment shown in FIGS. 8 and 9, grooves may be defined in the outer circumferential surfaces 146*a*, 148*a* and ridges may be disposed on the inner circumferential surfaces 142*a*, 144*a* so as to be fitted in the grooves.

The bearing structure 120 shown in FIG. 7 may be replaced with the corresponding parts of the bearing structure 140 shown in FIGS. 8 and 9.

With the arrangement of the present invention, as described above, the bearing structure has a support member in which a stepped small-diameter portion of a rotatable shaft is rotatably supported by a bearing, and the support member has a tubular sleeve disposed in a hole defined in a wall and inner and outer engaging members disposed on respective ends of the tubular sleeve and held respectively against opposite surfaces of the wall. The inner and outer engaging members held against the respective opposite surfaces of the wall are effective to retain the support member firmly on the wall against removal. Since no E-rings are required to hold the bearing in position on the shaft, the bearing can easily be assembled and serviced. A snap-fitting gear mounted on the shaft adjacent to the support member is securely protected against damage from thrust forces acting on the shaft.

Furthermore, first and second support members, each of the above construction, are mounted on respective ends of first and second rollers which grip and deliver a sheet. Accordingly, inasmuch as no E-rings are necessary, the first and second rollers and bearings which support the first and second rollers can easily be assembled and serviced.

Although certain preferred embodiments of the present invention have been shown and described in detail, it should be understood that various changes and modifications may be made therein without departing from the scope of the appended claims.

What is claimed is:

1. A bearing structure for a rotatable shaft, comprising:

a rotatable shaft having an end rotatably supported by a wall; and a support member detachably mounted on said wall, said end of said rotatable shaft being rotatably inserted and supported in said support member;

said support member comprising:

a tubular sleeve disposed in a hole defined in said wall; and an inner engaging member and an outer engaging member disposed on said tubular sleeve, wherein said inner engaging member is inserted axially through said hole defined in said wall such that said wall is interposed between said inner engaging member and said outer engaging member, and rotated to retain said support member on said wall against removal.

2. A bearing structure according to claim 1, further comprising a stepped small-diameter portion formed at said end of said rotatable shaft, and a bearing disposed in said support member, said stepped small-diameter portion being inserted in said bearing.

3. A bearing structure according to claim 1, wherein said end of said rotatable shaft has a stepped small-diameter portion and said support member has a bearing integrally formed therewith, said stepped small-diameter portion being inserted in said bearing.

4. A bearing structure according to claim 1, further comprising a stepped small-diameter portion formed at said end of said rotatable shaft, and a bearing of synthetic resin disposed in said support member, said stepped small-diameter portion being inserted in said bearing.

5. A bearing structure according to claim 4, wherein said support member has a first engaging surface on an inner circumference thereof and said bearing has a second engaging surface on an outer circumference thereof, said first engaging surface and said second engaging surface being held in engagement with each other to prevent said support member and said bearing from being turned relatively to each other.

6. A bearing structure according to claim 1, wherein said inner engaging member is disposed on an end of said tubular sleeve and held against a surface of said wall and said outer engaging member is disposed on an opposite end of said tubular sleeve and held against an opposite surface of said wall, whereby said inner and outer engaging members can jointly retain said support member on said wall against removal.

7. A bearing structure according to claim 6, wherein said outer engaging member has a flat surface for preventing said support member from being angularly moved about its own axis and an arcuate surface extending from said flat surface around the axis of said support member.

8. A bearing structure according to claim 7, wherein said wall has a ledge for engaging said flat surface to prevent said support member from being angularly moved about its own axis.

9. A bearing structure for rotatable shafts, comprising:

first and second rollers for gripping and delivering a sheet, said first and second rollers having respective ends rotatably supported by a wall; and first and second support members detachably mounted on said wall by axial insertion, said respective ends of said first and second rollers being rotatably inserted and supported in said first and second support members, respectively;

said first and second support members comprising:

respective first and second tubular sleeves disposed respectively in first and second holes defined in said wall; and respective first and second engaging members disposed on said first and second tubular sleeves, whereby said first and second engaging members are positioned on a same side of said wall and act to retain said first and second support members on said wall against removal.

10. A bearing structure according to claim 9, further comprising first and second stepped small-diameter portions formed at said ends of first and second rollers, respectively, and first and second bearings disposed in said first and second support members, respectively, said first and second stepped small-diameter portions being inserted in said first and second bearings, respectively.

11. A bearing structure according to claim 9, wherein said ends of first and second rollers have first and second stepped small-diameter portions, respectively, and said first and second support members have first and second bearings respectively, integrally formed therewith, said first and second stepped small-diameter portions being inserted in said first and second bearings, respectively.

12. A bearing structure according to claim 9, further comprising first and second stepped small-diameter portions formed at said ends of first and second rollers, respectively, and first and second bearings of synthetic resin disposed in said first and second support members, respectively, said first and second stepped small-diameter portions being inserted in said first and second bearings, respectively.

13. A bearing structure according to claim 12, wherein said first and second support members has respective first engaging surfaces on inner circumferences thereof and said first and second bearings have respective second engaging surfaces on outer circumferences thereof, said first engaging surfaces and said second engaging surfaces being held in engagement with each other to prevent said first and second support member and said first and second bearings from being turned relatively to each other.

14. A bearing structure for a rotatable shaft, comprising:

a rotatable shaft having an end rotatably supported by a wall; and a support member detachably mounted on said wall by axial insertion, said end of said rotatable shaft being rotatably inserted and supported in said support member;

said support member including, a tubular sleeve disposed in a hole de fined in said wall; and an engaging member disposed on said tubular sleeve, whereby said engaging member can retain said support member on said wall against removal, said engaging member including, an inner engaging member disposed on an end of said tubular sleeve and held against a surface of said wall; and an outer engaging member disposed on an opposite end of said tubular sleeve and held against an opposite surface of said wall, whereby said inner and outer engaging members jointly retain said support member on said wall against removal, wherein said wall has a recess defined therein in communication with said hole, said inner engaging member being movable through said recess when said support member is installed on said wall.

15. A bearing structure for rotatable shafts, comprising:

first and second rollers for gripping and delivering a sheet, said first and second rollers having respective ends rotatably supported by a wall; and first and second support members detachably mounted on said wall by axial insertion, said respective ends of said first and second rollers being rotatably inserted and supported in said first and second support members, respectively;

said first and second support members including, respective first and second tubular sleeves disposed respectively in first and second holes defined in said wall; and respective first and second engaging members disposed on said first and second tubular sleeves, whereby said first and second engaging members retain said first and second support members on said wall against removal, said first and second engaging members including, respective first and second inner engaging members disposed on respective ends of said first and second tubular sleeves and held against a surface of said wall; and respective first and second outer engaging members disposed on respective opposite ends of said first and second tubular sleeves and held against an opposite surface of said wall, whereby said first and second inner and outer engaging members jointly retain said first and second support members on said wall against removal.

16. A bearing structure according to claim 15, wherein said first and second outer engaging members have first and second flat surfaces, respectively, facing each other for preventing said first and second support members from being angularly moved about respective axes of said first and second support members, and first and second arcuate surfaces, respectively, extending from said first and second flat surfaces around said axes of said first and second support members, respectively.

17. A bearing structure according to claim 15, further comprising a spring disposed around said first and second outer engaging members for normally urging said first and second outer engaging members toward each other.

18. A bearing structure according to claim 15, wherein said wall has first and second recesses defined therein in communication with said first and second holes, respectively, said first and second inner engaging members being movable through said first and second recesses when said first and second support members are installed on said wall.

* * * * *